US005931382A

United States Patent [19]

Gross et al.

[11] Patent Number: 5,931,382

[45] Date of Patent: Aug. 3, 1999

[54] AERATING FOUNTAIN WITH SELECTABLE NOZZLE

[75] Inventors: Peter S. Gross, Plymouth; Kenneth A. Ingle, Brooklyn Center; Guy A. Hamilton, Richfield, all of Minn.

[73] Assignee: Aeromix Systems, Inc., Minneapolis, Minn.

[21] Appl. No.: 08/994,705

[22] Filed: Dec. 19, 1997

[51] Int. Cl.[6] ..... B05B 17/08

[52] U.S. Cl. ..... 239/17; 239/18; 239/391; 239/397; 261/93

[58] Field of Search ..... 239/16–18, 22, 239/390–3, 397, 436, 600; 261/93

[56] References Cited

U.S. PATENT DOCUMENTS

| | | | |
|---|---|---|---|
| Re. 29,075 | 12/1976 | Ravitts | 239/16 |
| 2,248,386 | 7/1941 | Richardson | 239/17 |
| 3,030,028 | 4/1962 | Hruby, Jr. | 239/17 |
| 3,041,976 | 7/1962 | Maynard | 239/17 |
| 3,735,926 | 5/1973 | Ravitts | 239/16 |
| 3,785,558 | 1/1974 | Albritton et al. | 239/16 |
| 3,889,880 | 6/1975 | Hruby, Jr. | 239/18 |
| 4,088,880 | 5/1978 | Walsh | 239/18 |
| 4,242,289 | 12/1980 | Blum | 261/93 |
| 4,259,367 | 3/1981 | Wang | 261/93 |
| 4,265,739 | 5/1981 | Dalton | 210/221 |
| 4,741,870 | 5/1988 | Gross | 261/93 |
| 4,920,465 | 4/1990 | Sargent | 239/18 |
| 5,160,667 | 11/1992 | Gross et al. | 261/91 |
| 5,183,596 | 2/1993 | Rajendren et al. | 261/93 |
| 5,762,833 | 6/1998 | Gross et al. | 261/93 |
| 5,800,704 | 9/1998 | Hansen | 210/169 |

OTHER PUBLICATIONS

"Mechanical Surface Aeration " by Ashbrook, Aug. 4, 1967.

*Primary Examiner*—Andres Kashnikow
*Assistant Examiner*—Lisa A. Douglas
*Attorney, Agent, or Firm*—Kinney & Lange, P.A.

[57] ABSTRACT

The present invention relates to an aerating fountain for use in aerating water and producing aesthetically appealing water sprays. The fountain has a float with an aperture running through its center. It has an electric motor with an impeller coupled to its shaft. The motor is mounted to the float such that the impeller is adjacent to the float aperture. The fountain has a nozzle plate having a set of nozzles. The nozzle plate is releasably coupled to a top side of the float such that one of the nozzles is disposed directly above the float aperture. The nozzle plate is coupled to the float in such a manner that it may be easily adjusted to bring a different nozzle into alignment with the float aperture.

20 Claims, 10 Drawing Sheets

AERATING FOUNTAIN WITH SELECTABLE NOZZLE

BACKGROUND OF THE INVENTION

The present invention relates to an aesthetic fountain that also functions as a fluid aeration device. In particular, the invention relates to an improved fountain which allows the nozzle to be changed easily and rapidly.

Aeration is a widely used technique for treating, oxidizing, and mixing a variety of different fluids. For example, aeration functions to revitalize stagnant bodies of water such as ponds with a fresh supply of air and thus oxygen. Similarly, municipal waste water treatment facilities utilize aeration to continuously oxygenate and treat waste water. Other applications, such as wine and beverage manufacturing and food processing plants, utilize aeration to either mix or maintain the fluid in question. In many instances, the fluid will contain suspended solids.

Aeration or fluid mixing can be accomplished with many different devices. In addition to fountains, these include forced air pumps, independent mixers, and submersible aerators. A significant advantage ofthe fountain is its dual function capability. In addition to providing an aerating function, the fountain also produces aesthetically appealing sprays of fluid.

Normally, the fountain will be placed in a fluid contained within a single tank-like structure or basin. This basin can range from a fabricated holding tank to a small body of water in which the recessed land forms a holding area The fountain generally operates while floating on the top surface of the body of fluid. A submersible pump is attached to the bottom side of the float and functions to draw fluid from slightly below the surface and propel it out a top surface of the floating fountain. The fluid propelled out the top of the fountain forms a spray pattern and the fluid entrains air and thus oxygen as it falls back to the top surface of the pond. The fountain also serves the function of mixing the fluid as it is drawn through the pump. The aesthetic function of the fountain is accomplished by placing a nozzle over the fountain exit The configuration of the nozzle controls the resulting spray pattern exiting the fountain.

Fountains such as those described above are known in the prior art. These prior art fountains, however, do not allow for rapid and easy changing of the nozzle. The fountains in the prior art use discrete and independent nozzles. To change spray patterns, one nozzle must be completely removed and another inserted in its place. In addition, these nozzles are often misplaced or lost. The present invention solves these and other problems associated with the prior art fountains.

SUMMARY OF THE INVENTION

The present invention is a device for producing aesthetic liquid sprays and aeration of the same. The invention allows for fast and easy changing of nozzles for producing various spray patterns. The invention consist of a pump, a float, and a nozzle plate. The float has an aperture extending from a bottom end to a top end. The pump has an impeller which is in communication with the float aperture. The plate contains a plurality of nozzles and is releasably coupled to the top end of the float.

DETAILED DESCRIPTION OF THE PREFERRED EMBODIMENTS

Figure 1:
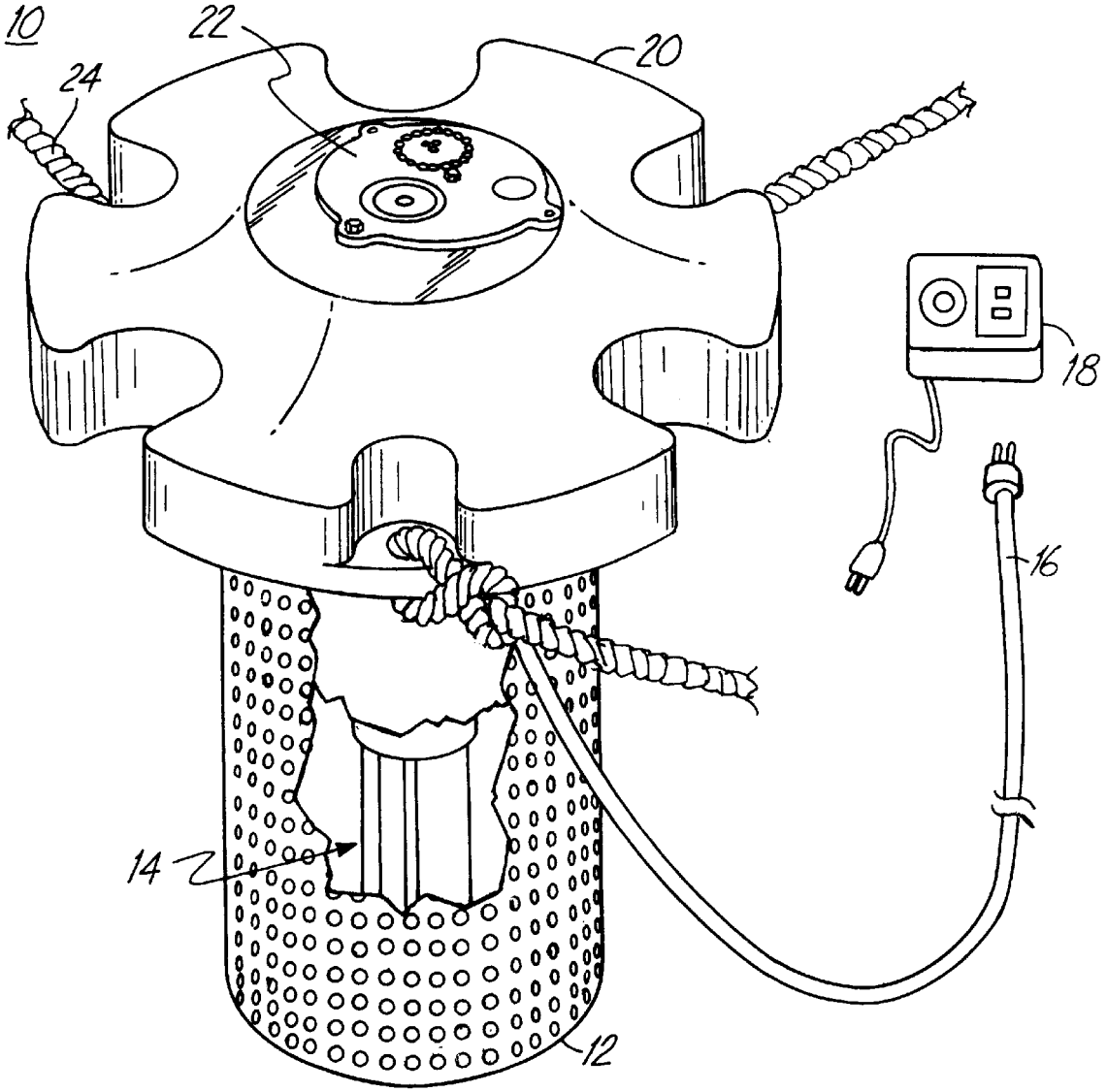
FIG. 1 is a perspective view of a fountain that also functions as a fluid aeration device.

FIG. 1 shows a preferred embodiment of an aerating fountain 10 in accordance with the present invention. The aerating fountain 10 is shown in FIG. 1 as fully assembled and ready for operation. The aerating fountain 10 includes a stainless steel screen 12, a pump 14, an electric cable 16, a controller 18, a float 20, a nozzle plate 22, and ropes 24. During operation, the float 20 floats partially submerged upon the surface of a body of water. The stainless steel screen 12 and the pump 14 are connected to a bottom side of the float 20 and are fully submerged beneath the water surface. The nozzle plate 22 is connected to a top of the float 20 and controls the appearance of the resulting spray of water during operation. The ropes 24 are used to secure the aerating fountain 10 in one position by securing them to the water container walls (not shown).

Figure 2:
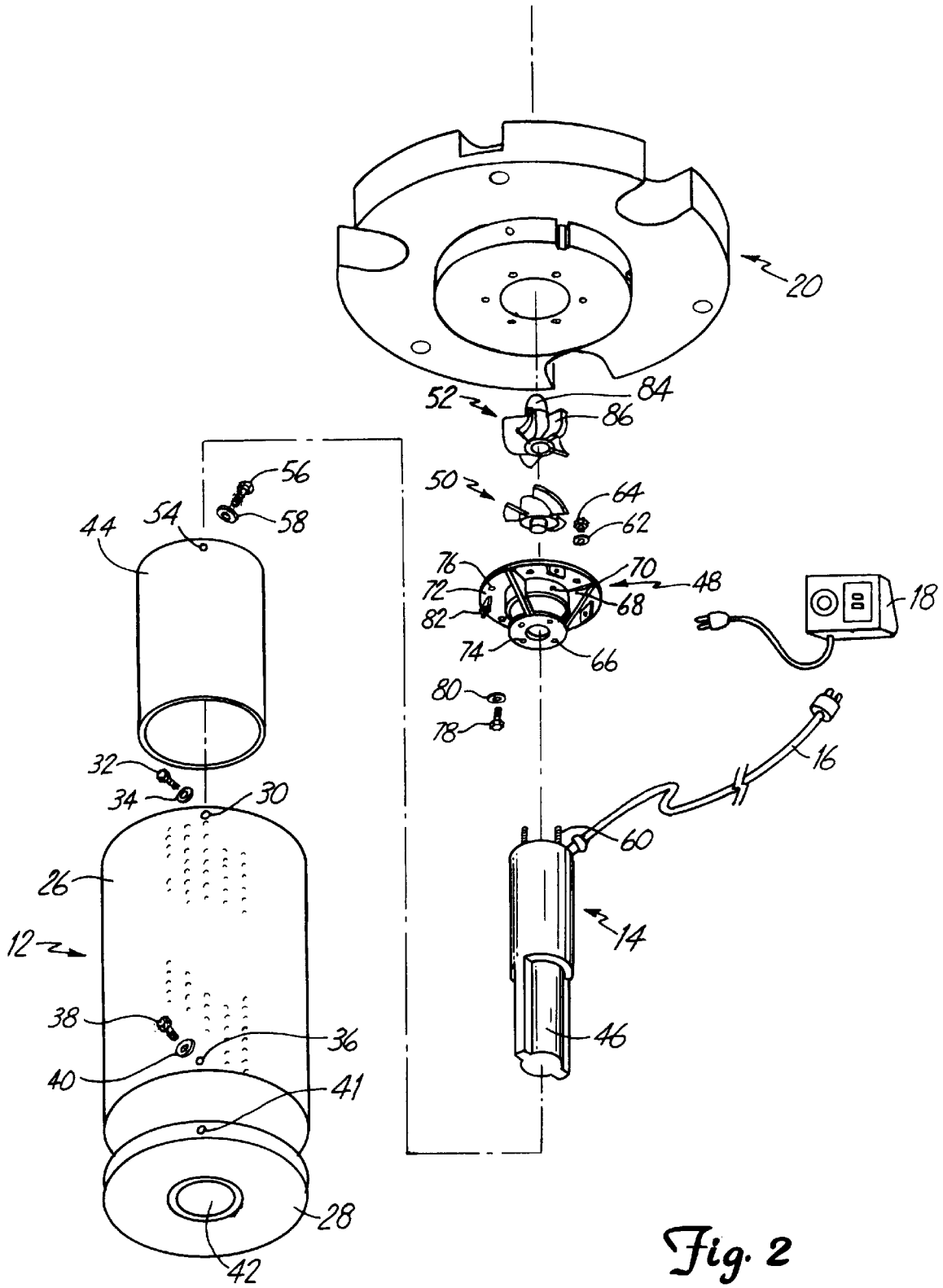
FIG. 2 is an exploded view of the fountain shown in FIG. 1.

FIG. 2 provides an exploded perspective view of the stainless steel screen 12, the pump 14, the electrical cable 16, the controller 18, and the float 20. The components shown in FIG. 2 will be described beginning at the bottom of the figure and moving towards the top.

The stainless steel screen 12 is shown at the bottom of FIG. 2. The stainless steel screen 12 includes a perforated cylinder 26 and a screen base 28. The perforated cylinder 26 is shaped as a thin-walled tube with the entire surface containing a homogeneous pattern of perforations extending from its outside to its inside surface. Three openings 30 are located near a top end of the perforated cylinder 26. The openings 30 are located an equal distance from the top end and are spaced at one hundred twenty degree intervals about the periphery of the perforated cylinder 26. The three openings 30 are used in conjunction with three hex bolts 32 and three lock washers 34 to connect the perforated cylinder 26 to a bottom side of the float 20. Three openings 36 are located near a bottom end of the perforated cylinder 26. The openings 36 are located an equal distance from the bottom end and are spaced at one hundred twenty degree intervals about the periphery of the perforated cylinder 26. The three openings 36 are used in conjunction with three hex bolts 38 and three lock washers 40 to connect the perforated cylinder 26 to the screen base 28. The screen base 28 is shaped as a disk and has a central depression 42, on its upper side, configured to accept and secure an end of the pump 14. The screen base 28 has three bolt receptors 41 disposed at one hundred twenty degree intervals about its periphery for accepting the hex bolts 38.

The middle section of FIG. 2 shows the components of the pump 14. The pump 14 includes a shroud 44, an electric motor 46, a motor base 48, an impeller 50, and a recouperator 52. The components of the pump 14, when fully assembled, function to draw water through the stainless steel screen 12, through the space between the shroud 44 and the electric motor 46, through the motor base 48, past the recouperator 52, and out a top side of the float 20. The pump 14 supplies the force that propels the water through the aerating fountain 10.

The shroud 44 is shaped as a thin-walled pipe extending in the longitudinal direction a length approximately equal to the length of the electric motor 46. Three openings 54 are located near an upper end of the shroud 44 and are spaced at one hundred twenty degree intervals about its periphery. The three openings 54 are used in conjunction with three hex bolts 56 and three lock washers 58 to connect the shroud 44 to the motor base 48. The openings 54 are equally spaced at one hundred twenty degree intervals about the periphery of the shroud 44. The electric motor 46 is a submersible electric motor of a type generally known in the art. Four motor hex bolts 60 extend upwards from a top surface of the electric motor 46. The four motor hex bolts 60 are configured such that they define the four comers of a square. The four motor hex bolts 60 are adapted for mounting the electric motor 46 to the motor base 48 using four lock washers 62 and four hex nuts 64. The electric motor 46 is connected to the controller 18 by the electrical cable 16. The controller 18 is a timing device of a type generally known in the art and is adapted to be connected to a standard 120-volt electrical outlet.

The motor base 48 acts as a housing for the impeller 50 and is used to mount the shroud 44 and the electric motor 46 to the float 20. The motor base 48 includes a motor plate 66, five arms 68, a cylinder 70, and a float plate 72. The motor plate 66 is shaped as a disk and has an aperture through its center. The motor plate 66 has four openings 74 located near its outer edge and based at equal distances from a center of the motor plate at of ninety degree intervals. The four openings 74 are configured to accept the four motor hex bolts 60 on the electric motor 46.

The five arms 68 are fastened to an upper surface of the motor plate 66. The arms 68 extend upwards and outwards from the motor plate 66 forming an angle of approximately forty-five degrees with respect to the motor plate 66. The four arms 68 are located at ninety degree intervals about the periphery of the motor plate 66.

The float plate 72 is fastened to an upper end of the arms 68. The float plate 72 has an aperture through its center having a diameter equal to the outside diameter of the cylinder 70. Float plate 72 also has six openings 76 extending from its bottom surface to its top surface. The six openings 76 are located an equal distance from a center of the float plate 72 and are spaced at equal angular intervals. The six openings 76 are used in conjunction with hex bolts 78 and lock washers 80 to mount the motor base 48 to the bottom side of the float 20. Three hex nuts 82 are mounted near an outer edge of the float plate 72 and extend downwards from its bottom surface. The three hex nuts 82 are located at equal distances from the center of the float plate 72 and are spaced at equal angular intervals. The three hex nuts 82 are used in conjunction with the three hex bolts 56 and the three lock washers 58 to mount the shroud 44 to the motor base 48.

The cylinder 70 is shaped as a thin-walled pipe and is connected to the float plate 72 such that its upper end is flush with an upper surface of the float plate 72. The impeller 50 is of a type known in the art. The impeller 50 is mounted to a shaft of the electric motor 46 and sized to fit within the cylinder 70 such that the cylinder 70 forms a housing around it.

The recouperator 52 mounts within a lower end of the float 20 and is disposed adjacent to the impeller 50. The recouperator 52 functions to remove the angular velocity component of the water after it exits the blades of the impeller 50. The recouperator 52 directs the water straight upwards towards the upper end of the float 20. The recouperator 52 includes a cylinder 84 and vanes 86. In a preferred embodiment, the recouperator 52 has five vanes 86 spaced at equal intervals about a periphery of the cylinder 84. Near the top end of the cylinder 84, the vanes 86 extend outwards from cylinder 84 and lie in the same plane as its center line. Moving longitudinally toward a bottom end of the cylinder 84, the vanes 86 incline in a clockwise direction about its periphery so as to form an arc in the longitudinal direction. The recouperator 52 mounts within the float 20 such that a bottom end of the recouperator 52 is flush with the bottom end of the float 20.

The components illustrated in FIG. 2 are assembled in the following manner. The recouperator 52 is inserted into and flush with the bottom end of the float 20. The electric motor 46 is attached to the motor base 48 using the motor hex bolts 60, the lock washers 62, and the hex nuts 64. The impeller 50 is mounted to the shaft of the electric motor 46 such that it sits within the cylinder 70. The motor base 48 is attached to the bottom side of the float 20 using the hex bolts 78 and the lock washers 80. The shroud 44 is disposed about the electric motor 46 and attached to the motor base 48, using the hex bolts 56 and the lock washers 58, in such a manner as to surround the electric motor 46 and form a water channel between the shroud 44 and the electric motor 46. The purpose of the shroud 44 is to direct water flow adjacent to an outer surface of the electric motor 46 so as to cool its outer surface and preventing overheating. Finally, the stainless steel screen 12 is attached to the bottom side of the float 20 using the hex bolts 32 and the lock washers 34. Once assembled as described, these components serve the purpose of propelling water, filtered of any large particles and debris, out through the top surface of the float 20. The float 20 will now be described in greater detail by referring to FIG. 3.

FIGS. 3A–3D show the float 20 in a perspective view, in a top plan view, in a sectional view, and in a bottom plan view. The float 20 functions as a flotation device and keeps the nozzle plate 22 (shown in FIG. 1) slightly above the water surface. The float 20 also serves the structural purpose of holding together all the components of the aerating fountain 10. The float 20 includes a mounting face 88, an upper portion 90, a central portion 92, and a lower portion 94.

Figure 3A:
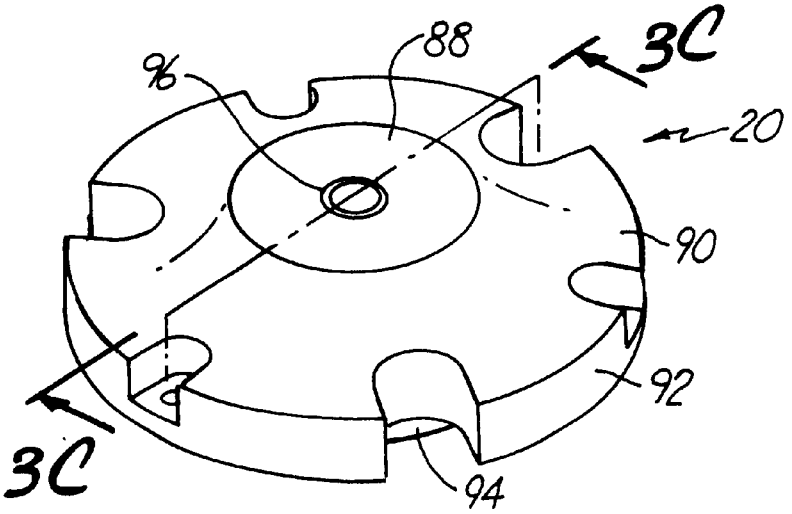
FIG. 3A is a perspective view of a float shown in FIG. 1.

As best shown in FIG. 3A, the float 20 is shaped as a disk having three distinct regions longitudinally from its top surface to its bottom surface. The mounting face 88 is shaped as a circle. Moving radially outward and longitudinally downward from the mounting face 88, the upper portion 90 extends to a diameter of approximately twice that of the mounting face 88. The central portion 92 extends longitudinally downward from the maximum diameter of the upper portion 90. The lower portion 94 extends longitudinally downwards from the central portion 92 and has a diameter approximately equal to the diameter of the mounting face 88. A groove 96 circumscribes an opening in a center of the mounting face 88.

Figure 3B:
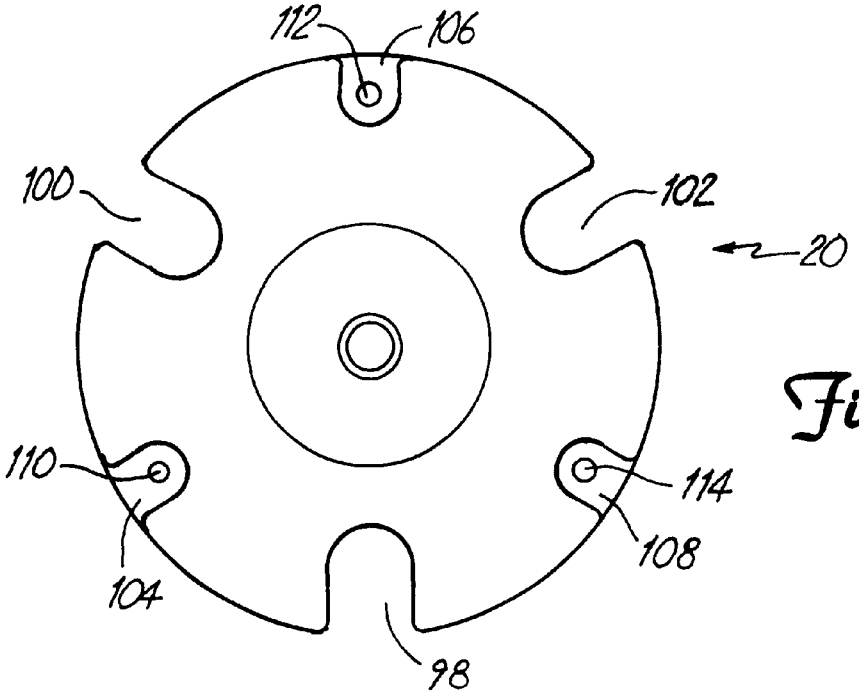
FIG. 3B is a top plan view of the float shown in FIG. 1.

As best shown in FIG. 3B, float 20 has three notches 98, 100, and 102, three hollows 104, 106, and 108, and three openings 110, 112, and 114. The notches 98, 100, and 102 extend through the upper portion 90 and the central portion 92 of the float 20 and extend from a periphery towards a center of the float 20. The hollows 104, 106, and 108 extend longitudinally through the upper portion 90 and part way through the central portion 92 of the float 20 and extend from the periphery towards the center of the float 20. The openings 110, 112, and 114 extend through the central portion 92 of the float 20 from the hollows 104, 106, and 108 to a bottom surface of the central portion 92.

Figure 3C:
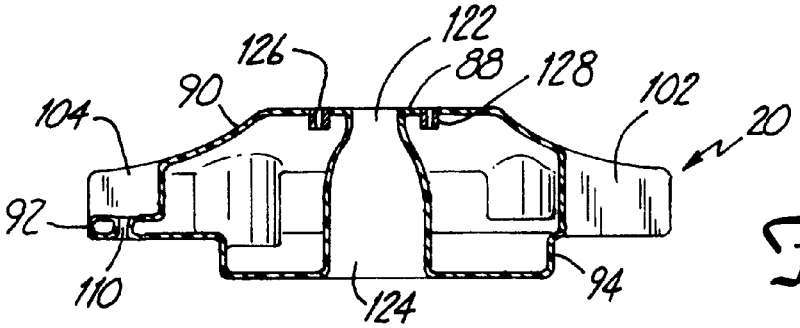
FIG. 3C is a sectional view of the float shown in FIG. 1 as taken along line 3C—3C in FIG. 3A.

The cross-sections of the hollows 104, 106, and 108 and the openings 110, 112, and 114 are best shown in the sectional view of FIG. 3C. FIG. 3C also best shows an upper bore 122 and a lower bore 124. The upper bore 122 extends from the mounting face 88 longitudinally downwards through the upper portion 90. The lower bore 124 extends longitudinally downwards through the central portion 92 and the lower portion 94. The upper bore 122 and the lower bore 124 are in communication and together form an aperture extending from the top surface to the bottom surface of the float 20. The diameter of the upper bore 122 narrows as it travels upwards in a longitudinal direction. The lower bore 124 is cylindrical having a constant diameter throughout. FIG. 3C also best shows threaded holes 126 and 128. The threaded holes 126 and 128 are disposed on either side of the upper bore 122 and fall on the line connecting a center of the opening 110 and a center of the notch 102. The threaded holes 126 and 128 extend downwards into upper portion 90 perpendicular to mounting face 88 and are adapted to accept bolts for mounting the nozzle plate 22.

Figure 3D:
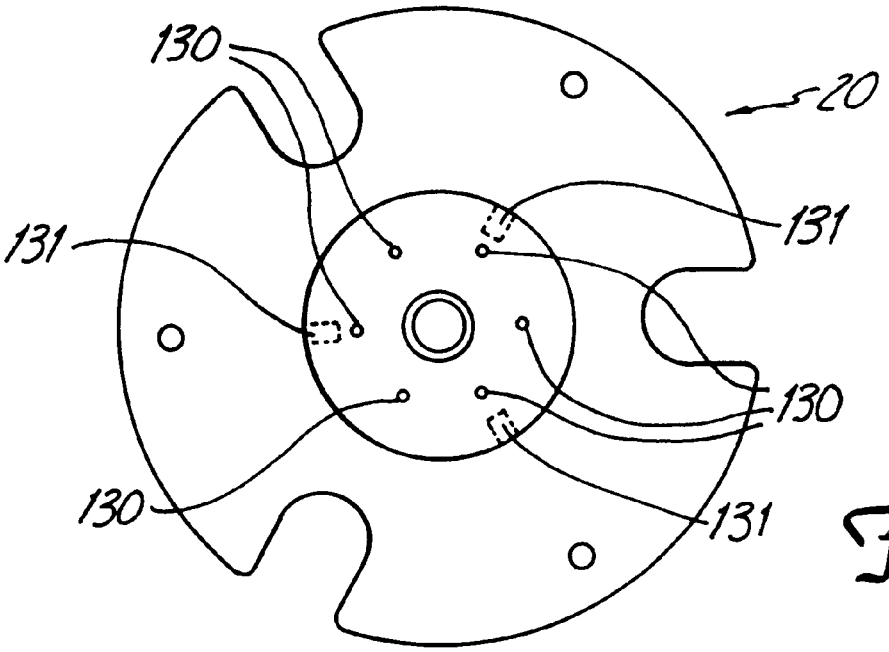
FIG. 3D is a bottom plan view of the float shown in FIG. 1.

FIG. 3D best shows six threaded holes 130. The threaded holes 130 extend upwards perpendicular to the bottom surface of the float 20 and are adapted to accept the six hex bolts 78 for mounting the motor base 48 (shown in FIG. 2) to the float 20. Three threaded holes 131 extend inwards from a periphery of the lower portion 124 towards the center of the float 20. The threaded holes 131 are adapted to accept the hex bolts 32 for mounting the stainless steel screen 12 (shown in FIG. 2) to the float 20.

Figure 4:
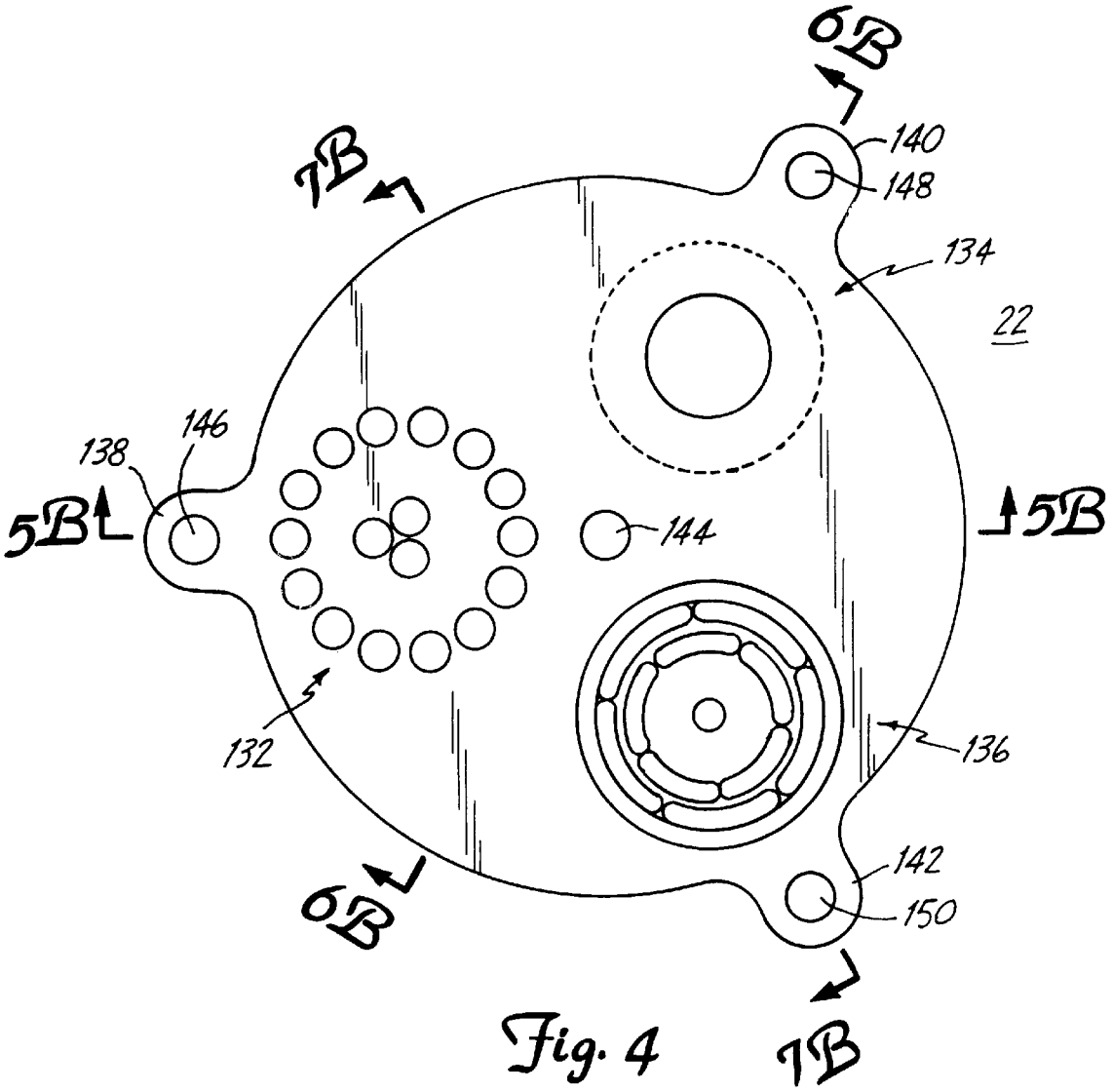
FIG. 4 is a top view of a nozzle plate.

The final component of the aerating fountain 10 is the nozzle plate 22. The nozzle plate 22 is the device that defines the appearance of the water spray. As best shown in FIG. 4, the nozzle plate 22 contains three separate nozzle patterns each of which produces a distinct water spray. The nozzle plate 22 includes, beginning at the left of FIG. 4 and moving in a clockwise direction, a first nozzle 132, a second nozzle 134, and a third nozzle 136. The nozzle plate 22 also has ears 138, 140, and 142 and a central aperture 144. The ears 138, 140, and 142 extend outward from a periphery of the nozzle plate 22 and are centered at one hundred twenty degree intervals about the periphery. Each of the ears 138, 140, and 142 has a corresponding opening 146, 148, and 150 through its center extending from the top surface to the bottom surface of the nozzle plate 22. The center of the first nozzle 132 is colinear with the line connecting the center of the nozzle plate 22 and the center of the opening 146. The center of second nozzle 134 is colinear with the line connecting the center of the nozzle plate 22 and the center of the opening 148. The center of the third nozzle 136 is colinear with the line connecting the center of the nozzle plate 22 and the center of the opening 150. In the radial direction, the first nozzle 132, the second nozzle 134, and the third nozzle 136 are located approximately halfway between the center of the nozzle plate 22 and the center of the openings 146, 148, and 150 respectively. The centers of the three nozzles 132, 134, and 136 lie on a common circle spaced at one hundred twenty degree intervals. The configuration of the nozzles 132, 134, and 136 on the nozzle plate 22 ensures that upon connection to the float 20, one nozzle is disposed such that it is concentric with the upper bore 122 (shown in FIG. 3C). Each of the nozzles will now be described separately using top views and sectional views.

Figure 5A:
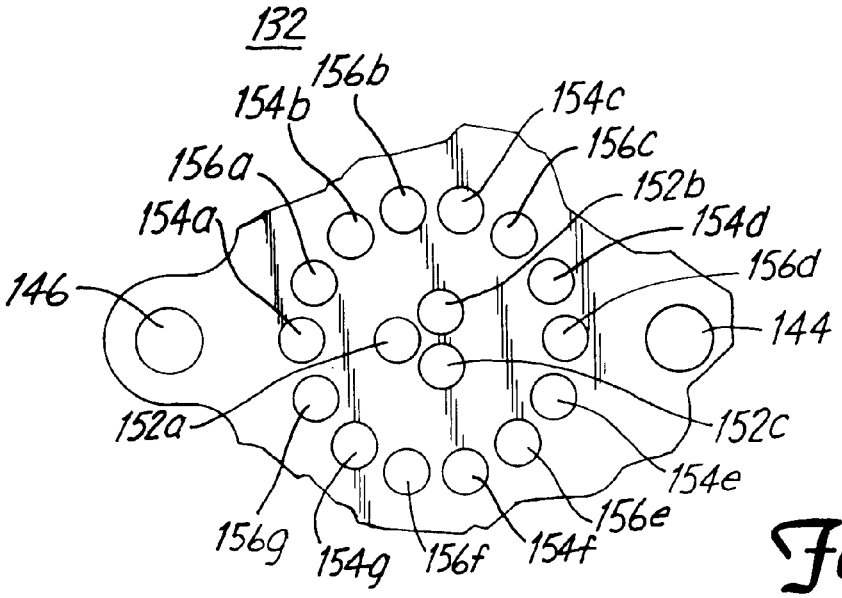
FIG. 5A is a top view of a first nozzle.
Figure 5B:
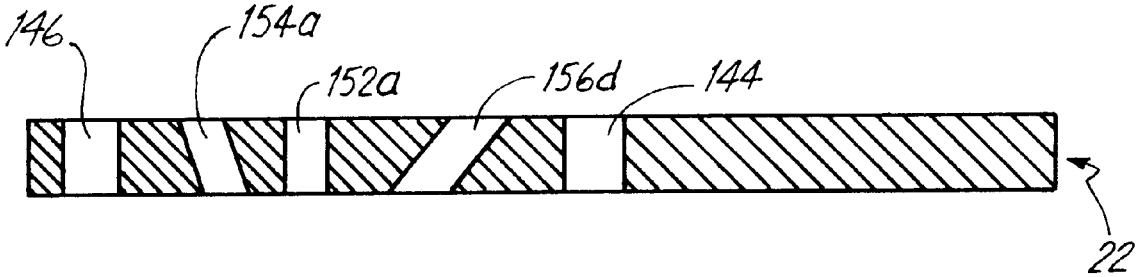
FIG. 5B is a sectional view of the nozzle plate as taken along line 5B—5B in FIG. 4.

FIGS. 5A and 5B show the first nozzle 132. FIG. 5A shows a top view of the first nozzle 132 as cut away from the nozzle plate 22 (shown in FIG. 4) and FIG. 5B shows a sectional view of the entire nozzle plate 22 as taken along the line 5B—5B in FIG. 4. The first nozzle 132 includes a series of openings 152*a*–152*c*, 154*a*–154*g*, and 156*a*–156*g* disposed between the opening 146 and the central aperture 144.

The three openings 152*a*, 152*b*, and 152*c* are spaced about a center of the first nozzle 132 and each opening 152*a*–152*c* is centered an equal radial distance from the center of the first nozzle 132. The radial distance of each of the openings 152*a*–152*c* from the center of the first nozzle 132 is such that each of the openings 152*a*–152*c* remain independent from the others. The openings 154*a*–154*g* and 156*a*–156*g* are located on a common circle centered at the center of the first nozzle 132 and at a radial distance from that center of about thee times the diameter of the openings 154*a*–154*g* and 156*a*–156*g*. As shown in FIG. 5A, the first nozzle 132 has, beginning at the far left and proceeding in a clockwise direction, openings 154*a*, 154*b*, 154*c*, 154*d*, 154*e*, 154*f*, and 154*g*. The first nozzle 132 also has, beginning at the far left and proceeding in a clockwise manner, openings 156*a*, 156*b*, 156*c*, 156*d*, 156*e*, 156*f*, and 156*g*. The openings 154*a*–154*g* and the openings 156*a*–156*g* are disposed about a common circle in an alternating manner such that they are independent from the adjacent openings. As best shown in FIG. 5B, each of the openings 154*a*–154*g* extend at a constant diameter, from a top surface to a bottom surface of the nozzle plate 22. The openings 154*a*–154*g* traverse the nozzle plate 22 at an angle of twenty degrees with respect to a perpendicular center line to the nozzle plate 22. The openings 156*a*–156*g* extend from the top surface of the bottom surface of the nozzle plate 22 at a constant diameter. The openings 156*a*–156*g* traverse the nozzle plate 22 at an angle of forty degrees with respect to the perpendicular center line of the nozzle plate 22.

Figure 6A:
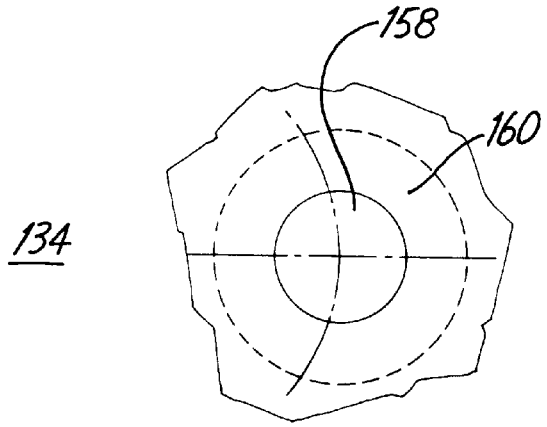
FIG. 6A is a top view of a second nozzle.
Figure 6B:
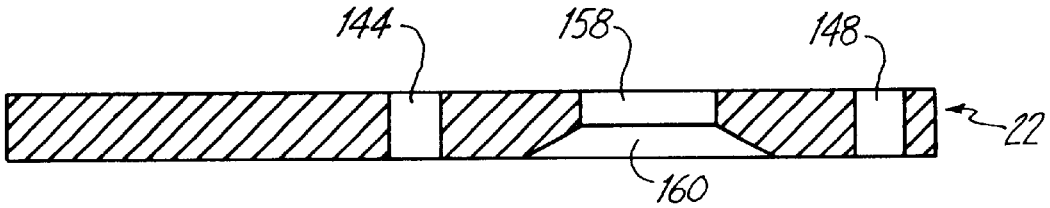
FIG. 6B is a sectional view of the nozzle plate as taken along line 6B—6B in FIG. 4.

FIGS. 6A and 6B show the second nozzle 134. FIG. 6A shows a top view of the second nozzle 134 as cut away from the nozzle plate 22 and FIG. 6B shows a sectional view of the nozzle plate 22 taken along the line 6B—6B in FIG. 4. The second nozzle 134 includes an upper bore 158 and a lower bore 160 disposed between the opening 148 and the central aperture 144. The upper bore 158 extends downwards perpendicular to the top surface of the nozzle plate 22 approximately halfway through the nozzle plate 22. The upper bore 158 defines a cylinder of a length approximately half the thickness of the nozzle plate 22. The upper bore 158 has a constant diameter throughout its length. The lower bore 160 extends from the terminus of the upper bore 158 to the lower surface of the nozzle plate 22. The lower bore 160 is conically shaped such that it increases in diameter as it travels from the upper bore 158 to the lower surface of the nozzle plate 22. The diameter of the lower bore 160 increases at a rate such that its edges extended form an angle of a twenty-eight degrees with respect to the lower surface of the nozzle plate 22. The lower bore 160 is in communication with the upper bore 158 such that they form an opening extending from the top surface to the bottom surface of the nozzle plate 22.

Figure 7A:
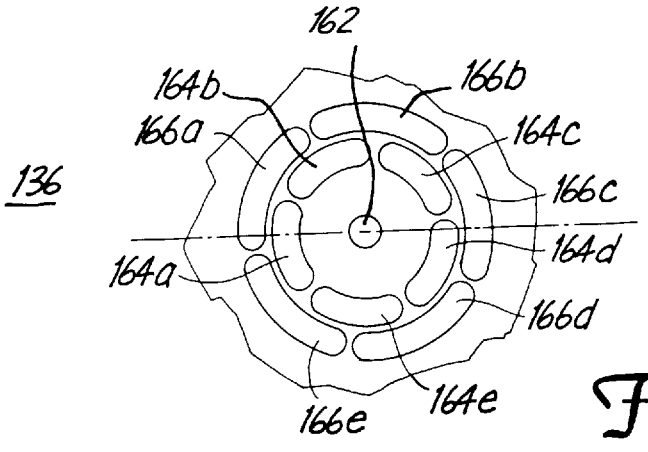
FIG. 7A is a top view of a third nozzle.
Figure 7B:
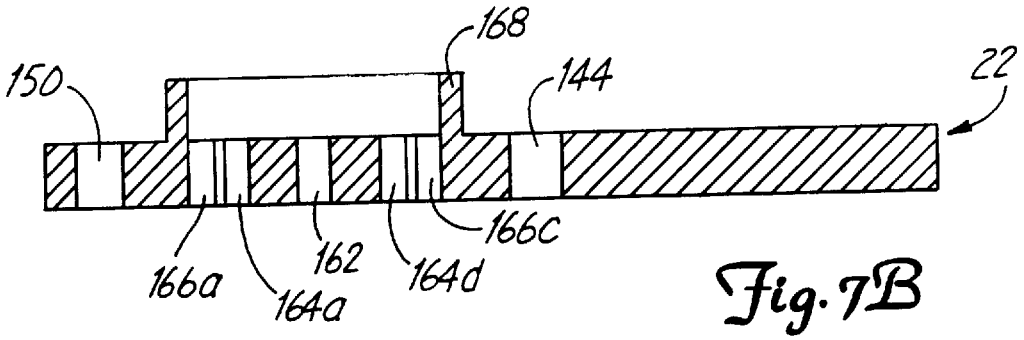
FIG. 7B is a sectional view of the nozzle plate as taken along line 7B—7B in FIG. 4.
Figure 7C:
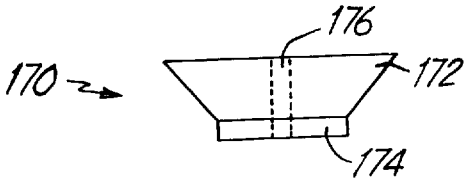
FIG. 7C is a side view of a cone.

FIGS. 7A–7C show the third nozzle 136. FIG. 7A shows a top view of the third nozzle 136 as cut away from the nozzle plate 22 and FIG. 7B shows a sectional view of the nozzle plate 22 as taken along the line 7B–7B in FIG. 4. The third nozzle 136 includes a bolt receptor 162, inner slots 164*a*–164*e*, outer slots 166*a*–166*e*, a lip 168, and a cone 170 disposed between the opening 150 and the central aperture 144. The bolt receptor 162 extends through a center of third nozzle 136 from the top surface to the bottom surface of the nozzle plate 22. The five inner slots 164*a*–164*e* lie on a common circle that is centered about the center of the third nozzle 136. The inner slots 164*a*–164*e* are disposed in an end-to-end manner such that they circumscribe the bolt receptor 162. The outer slots 166*a*–166*e* also lie on a common circle but at a greater radial distance from the center of the third nozzle 136. The outer slots 166*a*–166*e* are likewise disposed in an end-to-end manner such that they circumscribe the bolt receptor 162.

As best illustrated by FIG. 7B, the inner slots 164*a*–164*e* and the outer slots 166*a*–166*e* extend perpendicularly through the nozzle plate 22 from its top surface to its bottom surface. The lip 168 extends perpendicularly upwards from the top surface of the nozzle plate 22 in such a manner as to encircle the outer slots 166*a*–166*e*.

FIG. 7C shows the cone 170 which is the final component of the third nozzle 136. The cone 170 includes, from top to bottom, a conical portion 172 and a cylindrical portion 174. The conical portion 172 is shaped as a cone having a wider diameter at its upper end. The cylindrical portion 174 extends downwards from the narrow end of the conical portion 172 with a constant diameter. Opening 176 passes through a center of the conical portion 172 and the cylindrical portion 174 from a top surface to a bottom surface of the cone 170. The edges of the conical portion 172 form an angle of forty degrees with respect to a line running through the center ofthe cone 170. The cylindrical portion 174 of the cone 170 has a diameter approximately equal to the inside diameter formed by the inner slots 164*a*–164*e*. The cylindrical portion 174 is adapted to be mounted to an upper surface of the third nozzle 136 without occluding the inner slots 164*a*–164*e*.

Figure 8:
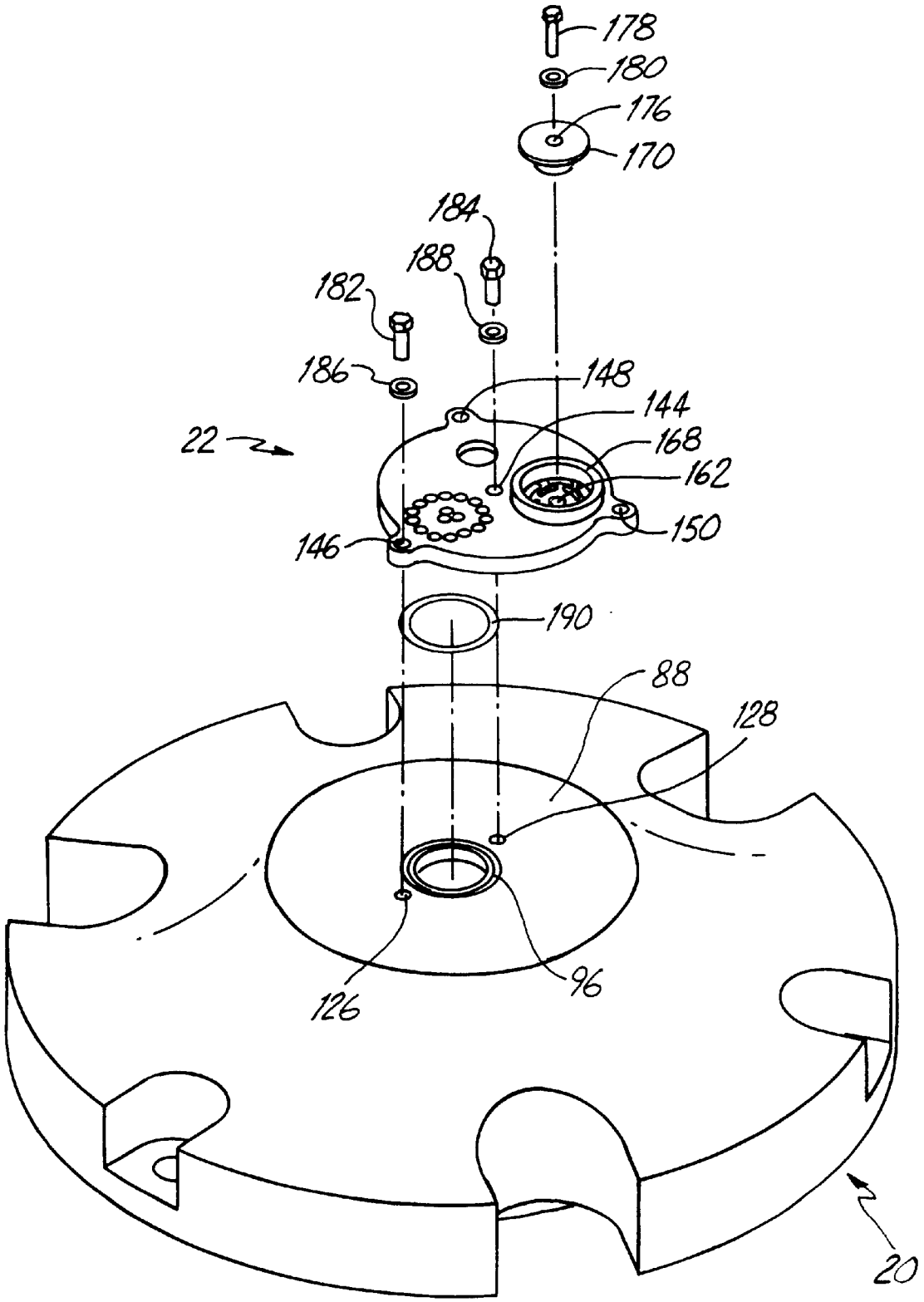
FIG. 8 is an exploded perspective view of the float and the nozzle plate of FIG. 1.

FIG. 8 illustrates how the nozzle plate 22 is mounted to the float 20. The cone 170 is mounted to the nozzle plate 22 using a hex bolt 178 and a lock washer 180. The hex bolt 178 extends through the lock washer 180, extends through the opening 176, and engages the internal threads of the bolt receptor 162. When mounted, the cone 170 is configured such that a water flow passage is created between the cone 170 and the lip 168. The nozzle plate 22 is mounted to the mounting face 88 using hex bolts 182, 184 and lock washers 186, 188. O-ring 190 sits within the groove 96 on the mounting face 88 and acts as a seal between the mounting face 88 and the nozzle plate 22. The nozzle plate 22 is mounted to the mounting face 88 by inserting the hex bolt 184 through the lock washer 188, through the central aperture 144 of the nozzle plate 22, and into the threaded hole 128. The nozzle plate 22 is then rotated about hex bolt 184 to bring the threaded hole 126 into alignment with one of the openings 146, 148, or 150. The hex bolt 182 is then inserted through the nozzle plate 22 and engages the internal threads of the threaded hole 126 to secure the nozzle plate 22.

Figure 9A:
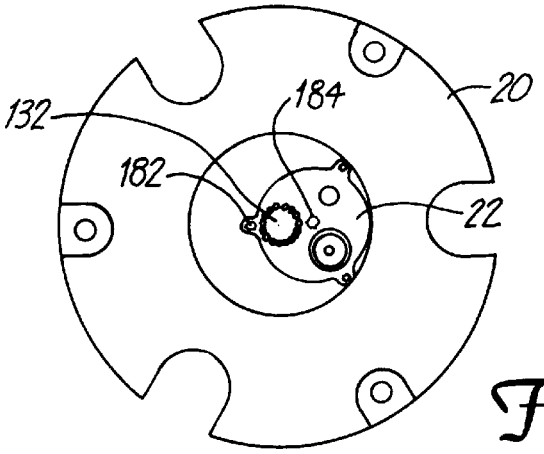
FIG. 9A is a top view of the float and the nozzle plate of FIG. 1 with the first nozzle in the active position.
Figure 9B:
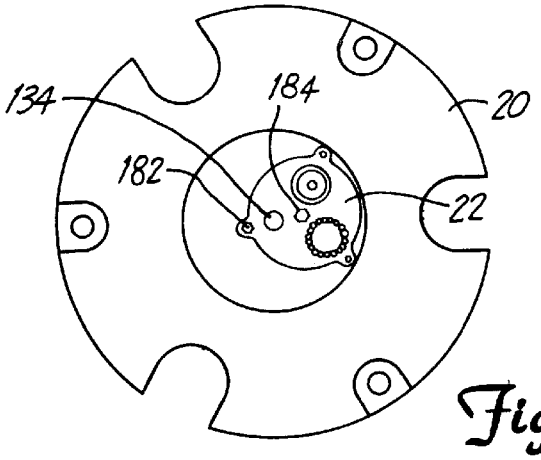
FIG. 9B is a top view of the float and the nozzle plate of FIG. 1 with the second nozzle in the active position.
Figure 9C:
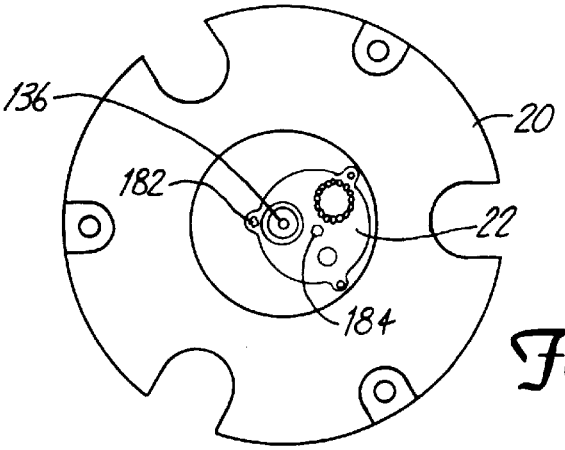
FIG. 9C is a top view of the float and the nozzle plate of FIG. 1 with the third nozzle in the active position.

FIGS. 9A–9C show each of the three possible nozzle plate 22 positions. FIG. 9A shows a top view of the float 20 and the nozzle plate 22 with the nozzle plate 22 mounted such that the first nozzle 132 is in the active position. In this configuration, the upper bore 122 (shown in FIG. 3C) of the float 20 is aligned with the first nozzle 132. When the aerating fountain 10 (shown in FIG. 1) is operated with the first nozzle 132 active, it produces a water spray pattern approximately nine feet high and twenty-two feet in diameter. To change the active nozzle from the first nozzle 132 (FIG. 9A) to the second nozzle 134 (FIG. 9B), the hex bolt 182 is removed and the nozzle plate 22 is rotated one hundred twenty degrees in the counterclockwise direction about the hex bolt 184. The hex bolt 182 is then refastened with the second nozzle 134 in communication with the upper bore 122 of the float 20. When the aerating fountain 10 is operated with the second nozzle 134 active, it produces a water spray pattern approximately ten feet high and ten feet in diameter. To change the active nozzle from the second nozzle 134 (FIG. 9B) to the third nozzle 136 (FIG. 9C), the same procedure is followed. When the aerating fountain 10 is operated with the third nozzle 136 active, it produces a water spray pattern approximately seven feet high and twenty-three feet in diameter. A fourth water spray pattern can be produced by removing the nozzle plate 22 entirely. When the aerating fountain 10 is operated with the nozzle plate 22 removed, it produces a water spray pattern approximately seven feet high and fourteen feet in diameter.

In an alternative embodiment, lights can be added to the aerating fountain 10 to provide for colored water sprays. The lights are secured in the notches 98, 100, and 102 of float 20 directed upward. The lights may be controlled using a separate set of electrical wiring connected to a separate controller. The color of the lights is generally changed manually, although remote color control lights may also be implemented.

As can be seen, the present invention allows for quick and easy changing of the active nozzle and thus the resulting water spray pattern. All available nozzles remain mounted to the float 20 at all times eliminating the need to store nozzles separately from the aerating fountain 10.

Although the present invention has been describe with reference to preferred embodiments, workers skilled in the art will recognize that changes may be made in form and detail without departing from the spirit and scope of the invention. For instance, any of an infinite variety of nozzles may be incorporated into the nozzle plate as described allowing for a corresponding infinite variety of water spray patterns. Additionally, although the aerating fountain has been described with three nozzle configurations on the nozzle plate, more than three nozzles would also be possible. Furthermore, although the present invention has been described with a submersible drive means, it should be appreciated that other configurations are also possible such as where the motor is positioned above the water surface.

We claim:

1. A fountain for producing multiple spray patterns comprising:

a float having an aperture therethrough, the aperture having a top end and a bottom end;

an electric motor having a shaft, the shaft coupled to an impeller, the electric motor mounted below the float such that the impeller is adjacent to the bottom end of the aperture;

a plate having a plurality of nozzles, the nozzles located equal distances from a center of the plate, each nozzle configured to produce a distinct spray pattern; and means for releasably coupling the plate to the float such that one of the plurality of nozzles is disposed immediately adjacent to the top end of the aperture.

2. An aerating fountain as defined in claim 1, further comprising a recouperator for directing flow from the impeller toward the top end of the aperture, the recouperator located within the aperture near the bottom end.

3. An aerating fountain as defined in claim 1, wherein the float is constructed from polyethylene.

4. An aerating fountain as defined in claim 1, wherein the aperture narrows toward the top end such that the diameter at the top end is less than the diameter at the bottom end.

5. An aerating fountain as defined in claim 1, wherein the electric motor is connected to the float using bolts.

6. An aerating fountain as defined in claim 1, wherein the plate has three nozzles centered at one hundred twenty degree intervals and equal distances from the center of the plate.

7. An aerating fountain as defined in claim 1, wherein the plate is coupled to the float using bolts.

8. An aerating fountain as defined in claim 1, wherein the plate has a central aperture therethrough and a plurality of outer apertures colinear with the central aperture and the plurality of nozzles.

9. An aerating fountain as defined in claim 8, wherein the plate is coupled to the float using a first bolt and a second bolt, the first bolt extending through the central aperture and the second bolt extending through one of the outer apertures.

10. An aerating fountain for producing multiple spray patterns comprising:

a float having an aperture through its center, the float having a planar upper surface and a lower surface;

a submersible electric motor having a shaft connected to an impeller;

means for mounting the submersible electric motor to the lower surface of the float such that the impeller is disposed adjacent to a lower end of the aperture;

the plate having a plurality of nozzles, the nozzles located equal distances from a center of the plate, each nozzle configured to produce a distinct spray pattern; and means for releasably coupling the plate to the upper surface of the float such that one of the plurality of nozzles is disposed immediately adjacent to a top end of the aperture.

11. An aerating fountain is defined in claim 10, further comprising a shroud for directing fluid flow past an outer surface of the submersible electric motor, the shroud surrounding the submersible electric motor and connected to the lower surface of the float.

12. An aerating fountain is defined in claim 10, further comprising a screen mounted to the lower surface of the float such that it completely surrounds the submersible electric motor.

13. An aerating fountain as defined in claim 10, wherein the plate has three nozzles located equal distances from the center of the plate and located at one hundred twenty degree intervals.

14. An aerating fountain as defined in claim 10, further comprising a controller for controlling operation of the submersible electric motor, the controller connected to the submersible electric motor by an electric cable.

15. An aerating fountain as defined in claim 10, wherein the float has a notch for accepting lights.

16. An aerating fountain as defined in claim 10, wherein the plate has a central aperture therethrough and a plurality of outer apertures colinear with the central aperture and centers of the plurality of nozzles.

17. An aerating fountain as defined in claim 16, wherein the plate is coupled to the float using a first bolt and a second bolt, the first bolt extending through the central aperture and the second bolt extending through one of the plurality of outer apertures.

18. An aerating fountain as defined in claim 10, further comprising an O-ring, the O-ring located in a groove circumscribing a top end of the aperture for creating a seal between the float and the plate.

19. An aerating fountain for producing multiple spray patterns comprising:

a float having an aperture therethrough, the aperture having a top end and a bottom end wherein the aperture is tapered such that the diameter at the top end is less than the diameter at the bottom end;

an electric motor having a shaft, the shaft coupled to an impeller, the electric motor mounted to the float such that the impeller is adjacent to the bottom end of the aperture;

a plate having a plurality of nozzles, the nozzles located equal distances from a center of the plate; and means for releasably coupling the plate to the float such that one of the plurality of the nozzles is disposed immediately adjacent to the top end of the aperture.

20. An aerating fountain for producing multiple spray patterns comprising:

a float having an aperture through its center, the float having a planar upper surface and a lower surface;

a submersible electric motor having a shaft connected to an impeller;

a shroud for directing fluid flow past an outer surface of the submersible electric motor;

means for mounting the submersible electric motor to the lower surface of the float such that the impeller is disposed adjacent to a lower end of the aperture;

a plate having a plurality of nozzles, the nozzles located equal distances from a center of the plate; and means for releasably coupling the plate to the upper surface of the float such that one of the plurality of nozzles is disposed immediately adjacent to a top end of the aperture.

* * * * *